US007862201B2

(12) United States Patent
Ge et al.

(10) Patent No.: US 7,862,201 B2
(45) Date of Patent: Jan. 4, 2011

(54) FLUORESCENT LAMP FOR LIGHTING APPLICATIONS

(75) Inventors: Shichao Ge, San Jose, CA (US); Victor Lam, Hong Kong (HK)

(73) Assignee: TBT Asset Management International Limited, Tortola (VG)

( * ) Notice: Subject to any disclaimer, the term of this patent is extended or adjusted under 35 U.S.C. 154(b) by 234 days.

(21) Appl. No.: 11/458,924

(22) Filed: Jul. 20, 2006

(65) Prior Publication Data

US 2007/0041182 A1 Feb. 22, 2007

(30) Foreign Application Priority Data

| | | | |
|---|---|---|---|
| Jul. 20, 2005 | (CN) | ..... | 2005 2 0013482 U |
| Jul. 20, 2005 | (CN) | ..... | 2005 2 0013483 U |
| Jul. 20, 2005 | (CN) | ..... | 2005 2 0013484 U |
| Nov. 21, 2005 | (CN) | ..... | 2005 2 0116564 U |
| Dec. 1, 2005 | (CN) | ..... | 2005 2 0116919 U |

(51) Int. Cl.
*F21V 33/00* (2006.01)

(52) U.S. Cl. ..... 362/217.09; 362/216; 362/217.08; 362/227; 362/260; 362/640; 362/650; 313/493; 313/573; 313/634

(58) Field of Classification Search ..... 362/226, 362/260, 640, 216, 217.08, 217.09, 227, 362/650; 313/493, 573, 634
See application file for complete search history.

(56) References Cited

U.S. PATENT DOCUMENTS

| | | | | |
|---|---|---|---|---|
| 1,870,147 | A | 8/1932 | Smally | |
| 2,501,375 | A | 3/1950 | Breadner et al. | |
| 3,253,176 | A * | 5/1966 | Pate et al. | 313/306 |
| 3,660,839 | A | 5/1972 | Wittman et al. | |
| 3,812,393 | A | 5/1974 | Koo et al. | |
| 4,017,758 | A | 4/1977 | Almer et al. | |
| 4,137,483 | A | 1/1979 | Ochi et al. | |
| 4,161,020 | A | 7/1979 | Miller | |
| 4,300,073 | A | 11/1981 | Skwirut et al. | |
| 4,871,944 | A | 10/1989 | Skwirut et al. | |

(Continued)

FOREIGN PATENT DOCUMENTS

CN 1168117 C 9/2004

(Continued)

OTHER PUBLICATIONS

USPTO, "Office Action," mailed in related U.S. Appl. No. 11/055,536 on Sep. 26, 2007, 23 pages.

(Continued)

*Primary Examiner*—Sandra L O'Shea
*Assistant Examiner*—Mary Zettl
(74) *Attorney, Agent, or Firm*—Davis Wright Tremaine LLP

(57) ABSTRACT

A lighting device comprises a serpentine shaped CCFL, a driver driving the CCFL, a connector that allows the device to connect to and receive power from conventional power sockets, and a fixture that connects them into a single device. Such device can be used for general lighting purposes and replaces incandescent and other fluorescent lamps in current use without having to change electrical sockets. The fixture mechanically connects the CCFL, the driver and the connector to form an unitary mechanical structure. Preferably an air gap is maintained between the CCFL and the driver.

38 Claims, 9 Drawing Sheets

U.S. PATENT DOCUMENTS

| | | | | |
|---|---|---|---|---|
| 5,497,048 | A | 3/1996 | Burd | |
| 5,561,539 | A | 10/1996 | Funahata et al. | |
| 5,702,179 | A | 12/1997 | Sidwell et al. | |
| 5,751,104 | A | 5/1998 | Soules et al. | |
| 5,775,801 | A * | 7/1998 | Shaffer | 362/310 |
| 6,011,354 | A | 1/2000 | Tsai et al. | |
| 6,050,704 | A | 4/2000 | Park | |
| 6,053,623 | A | 4/2000 | Jones et al. | |
| 6,054,806 | A | 4/2000 | Holzer | |
| 6,064,155 | A | 5/2000 | Maya et al. | |
| 6,211,612 | B1 | 4/2001 | Ge | |
| 6,316,872 | B1 | 11/2001 | Ge et al. | |
| 6,515,433 | B1 | 2/2003 | Ge et al. | |
| 6,633,128 | B2 | 10/2003 | Hyes et al. | |
| 6,672,733 | B2 | 1/2004 | Nagatani | |
| 6,674,250 | B2 | 1/2004 | Cho et al. | |
| 6,762,559 | B1 | 7/2004 | Ishikawa et al. | |
| 6,765,633 | B2 | 7/2004 | Eom | |
| 6,793,370 | B2 | 9/2004 | Moon et al. | |
| 6,879,114 | B2 | 4/2005 | Jales et al. | |
| 6,949,890 | B2 | 9/2005 | Chou et al. | |
| 7,141,933 | B2 | 11/2006 | Ball | |
| 7,178,944 | B2 | 2/2007 | Walton | |
| 7,198,389 | B1 | 4/2007 | Kwong et al. | |
| 7,205,712 | B2 * | 4/2007 | Yan | 313/493 |
| 7,258,475 | B2 * | 8/2007 | Kurumatani | 362/547 |
| 7,309,964 | B2 | 12/2007 | Wey et al. | |
| 7,357,528 | B2 | 4/2008 | Marsh | |
| 2002/0017866 | A1 | 2/2002 | Lee | |
| 2002/0163529 | A1 * | 11/2002 | Evanicky | 345/600 |
| 2003/0179577 | A1 * | 9/2003 | Marsh | 362/260 |
| 2003/0201967 | A1 | 10/2003 | Yu | |
| 2003/0223230 | A1 * | 12/2003 | Li | 362/216 |
| 2004/0095791 | A1 * | 5/2004 | Huang et al. | 363/132 |
| 2004/0129894 | A1 | 7/2004 | Coulombe et al. | |
| 2004/0130252 | A1 | 7/2004 | Ge et al. | |
| 2004/0184269 | A1 | 9/2004 | Walton | |
| 2004/0240202 | A1 | 12/2004 | Sauska et al. | |
| 2004/0257793 | A1 | 12/2004 | Wakabayashi | |
| 2005/0036315 | A1 * | 2/2005 | Marsh | 362/260 |
| 2005/0104522 | A1 | 5/2005 | Yabuki et al. | |
| 2005/0141151 | A1 * | 6/2005 | Azodi | 361/15 |
| 2005/0162089 | A1 * | 7/2005 | Iida et al. | 313/634 |
| 2005/0174769 | A1 * | 8/2005 | Yong et al. | 362/235 |
| 2005/0184684 | A1 | 8/2005 | Matsushima et al. | |
| 2005/0218808 | A1 | 10/2005 | Hsu et al. | |
| 2005/0219647 | A1 * | 10/2005 | Lee et al. | 358/484 |
| 2005/0265023 | A1 * | 12/2005 | Scholl | 362/229 |
| 2005/0265025 | A1 | 12/2005 | Jang et al. | |
| 2005/0275351 | A1 | 12/2005 | Ge | |
| 2006/0023470 | A1 | 2/2006 | Chen et al. | |
| 2006/0028921 | A1 * | 2/2006 | Wang et al. | 368/238 |
| 2006/0072311 | A1 * | 4/2006 | Tseng et al. | 362/216 |
| 2006/0245213 | A1 * | 11/2006 | Beil et al. | 362/616 |
| 2006/0256244 | A1 * | 11/2006 | Jak et al. | 349/33 |
| 2006/0273731 | A1 | 12/2006 | Ge | |
| 2008/0049434 | A1 | 2/2008 | Marsh | |

FOREIGN PATENT DOCUMENTS

| | | | |
|---|---|---|---|
| CN | 1725430 | A | 1/2006 |
| DE | 195 48 325 | A1 | 6/1997 |
| EP | 1 263 020 | A2 | 12/2002 |
| FR | 837 795 | A | 2/1939 |
| GB | 984667 | | 3/1965 |
| JP | 01 173537 | A | 7/1988 |
| JP | 05 108776 | A | 4/1993 |
| JP | 05 347084 | A | 12/1993 |
| JP | 06 059590 | A | 3/1994 |
| JP | 07-01453 | | 1/1995 |
| JP | 10-189259 | | 5/1995 |
| WO | WO 01/20642 | A1 | 3/2001 |
| WO | WO 03/083896 | A1 | 10/2003 |
| WO | WO 2005/078763 | A2 | 4/2005 |
| WO | WO 2005/078763 | A3 | 8/2005 |
| WO | WO 2007/012087 | | 1/2007 |
| WO | WO 2007/012087 | A2 | 1/2007 |
| WO | WO 2007/012087 | A3 | 5/2007 |

OTHER PUBLICATIONS

"Compact Fluorescent Lamp", Wikipedia, http://en.wikipedia.org/wiki/Compact_fluorescent_lamp, Dec. 19, 2007, pp. 1-19.

"FAQ's: Compact Fluorescent: GE Commercial Lighting Products", http://www.gelighting.com/na/business_lighting/faqs/cfl.htm; Dec. 19, 2007, pp. 1-5.

Samuel M. Goldwasser and Donald L. Klipstein "Compact Fluorescent Lamps" http://members.misty.com/don/cf.html, Dec. 19, 2007, pp. 1-3.

Invitaion to Pay Additional Fees, mailed in related Application No. PCT/US2006/028588 mailed on Dec. 18, 2006, 5 pages.

Notification of Transmittal of the International Search Report and the Written Opinion of the International Searching Authority, or the Declaration, mailed in related Application No. PCT/US2006/028588 on Apr. 3, 2007, 14 pages.

R. Y. Pai, "Efficiency Limits for Fluorescent Lamps and Application to LCD Backlighting", Journal of the SID, May 4, 1997, pp. 371-374.

L. E. Tannas, Jr., "Flat Panel Displays and CRTs", Von Nostrand Reinhold, New York, 1985, pp. 339.

USPTO, "Office Action," mailed in related U.S. Appl. No. 11/055,536 on May 30, 2008, 49 pages.

European "First Office Action", mailed in corresponding European Patent Application No. 06788251.4, on Jun. 27, 2008, 2 pgs.

EPO/ISA, PCT "International Preliminary Report on Patentability," International Application No. PCT/US2006/028588, Jul. 20, 2006, 1 pg.

EP/ISA, PCT "Written Opinion," International Application No. PCT/US 2006/028588, Jul. 20, 2006, 8 pgs.

H. Noguchi, "A 50,000-hour Lifetime Cold-Cathode Fluorescent Lamp for LCD Backlighting," Harrison Electric Co., Ltd. Ehime, Japan, SID 99 Digest, 1999, pp. 908-911.

USPTO "Office Action", mailed in related U.S. Appl. No. 11/055,536 on Oct. 8, 2008, 40 pages.

EPO "Office Action", mailed in corresponding European Patent Application No. 06 788 251.4 on Mar. 30, 2009, 4 pages.

USPTO "Office Action", mailed in related U.S. Appl. No. 11/442,320 on Apr. 7, 2009 , 20 pages.

CN "Office Action" mailed in corresponding Chinese Patent Office Application No. 200680030348.9 on Apr. 30, 2009, 17 pages.

USPTO "Final Office Action" mailed in related U.S. Appl. No. 11/055,536 on May 12, 2009, 27 pages.

USPTO "Office Action" mailed in related U.S. Appl. No. 11/055,536 on Oct. 5, 2009, 50 pages.

EPO "Office Action" mailed in corresponding European application No. 06 788 251.4 on Oct. 29, 2009, 4 pages.

USPTO "Office Action" mailed in related U.S. Appl. No. 11/934,605 on Nov. 13, 2009, 45 pages.

EPO "Office Action" mailed in corresponding European application No. 06 788 251.4 on Apr. 20, 2010, 5 pages.

USPTO "Office Action" mailed in related U.S. Appl. No. 11/055,536 on May 14, 2010, 45 pages.

USPTO, "Office Action" mailed Jul. 9, 2010 in related U.S. Appl. No. 11/422,320,18 pages.

USPTO, "Office Action" mailed Jul. 9, 2010 in related U.S. Appl. No. 11/934,605,47 pages.

* cited by examiner

Fig. 10A
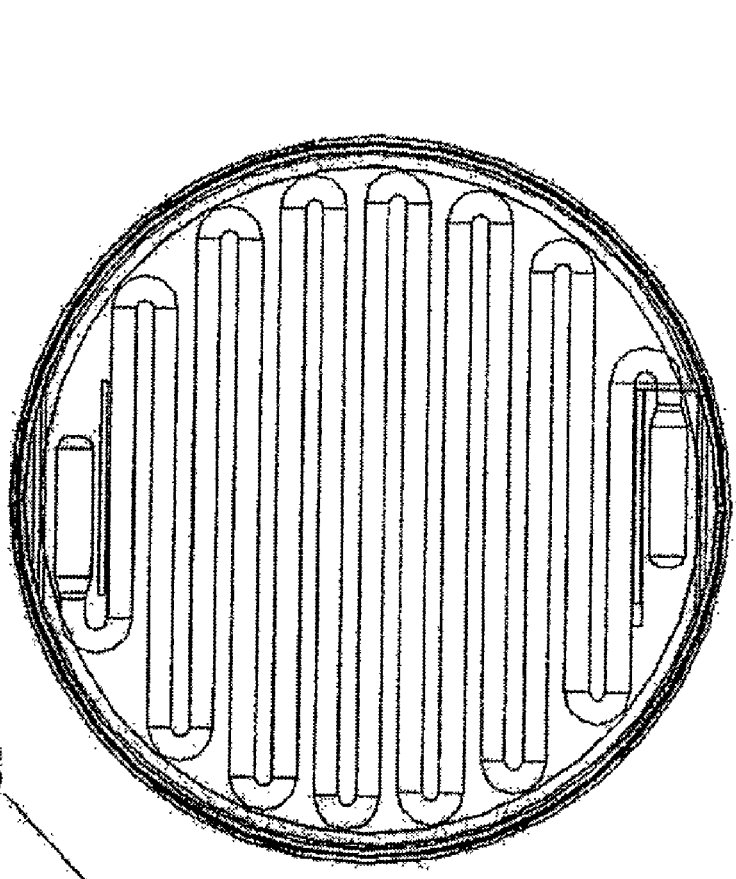
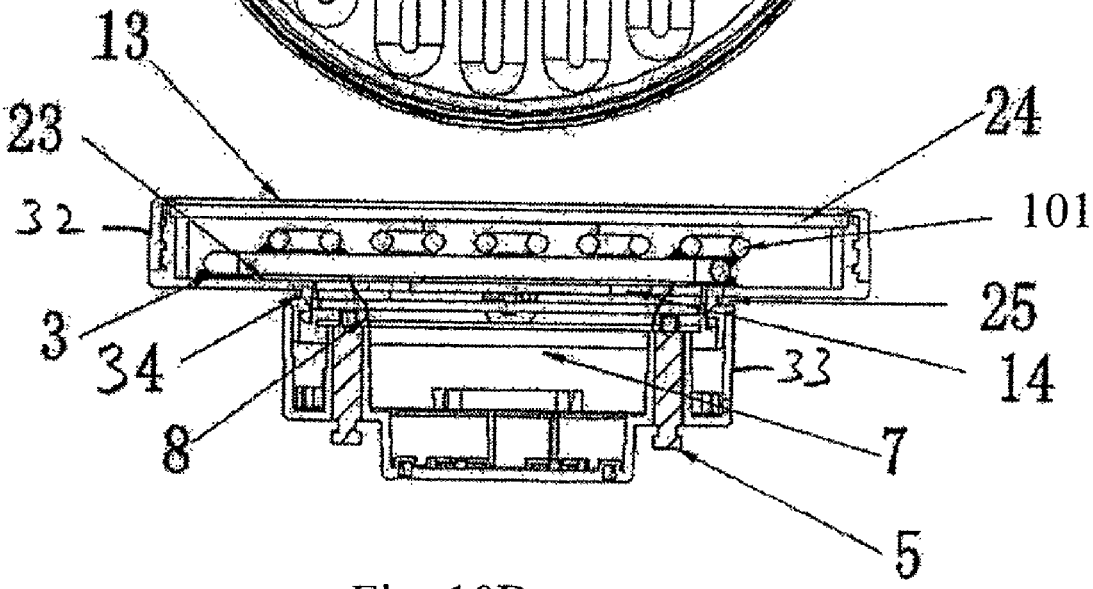
Fig. 10B

Fig. 11A
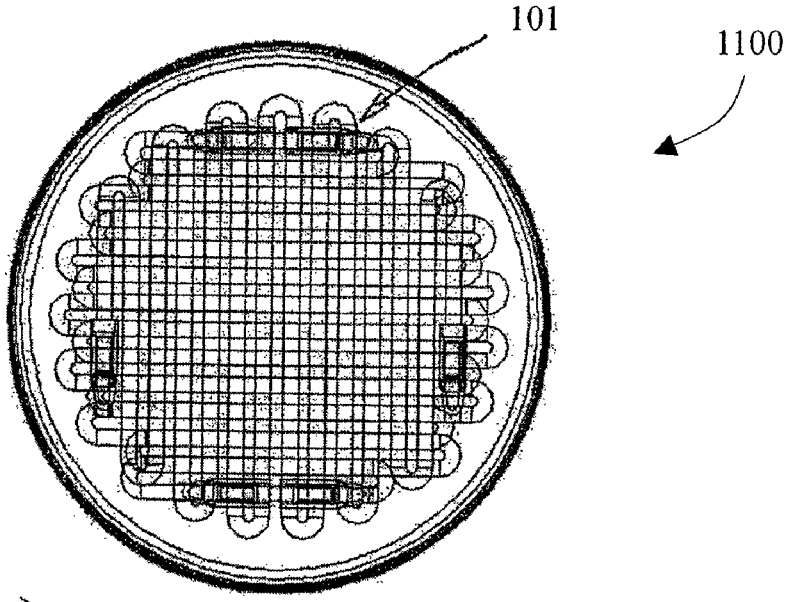
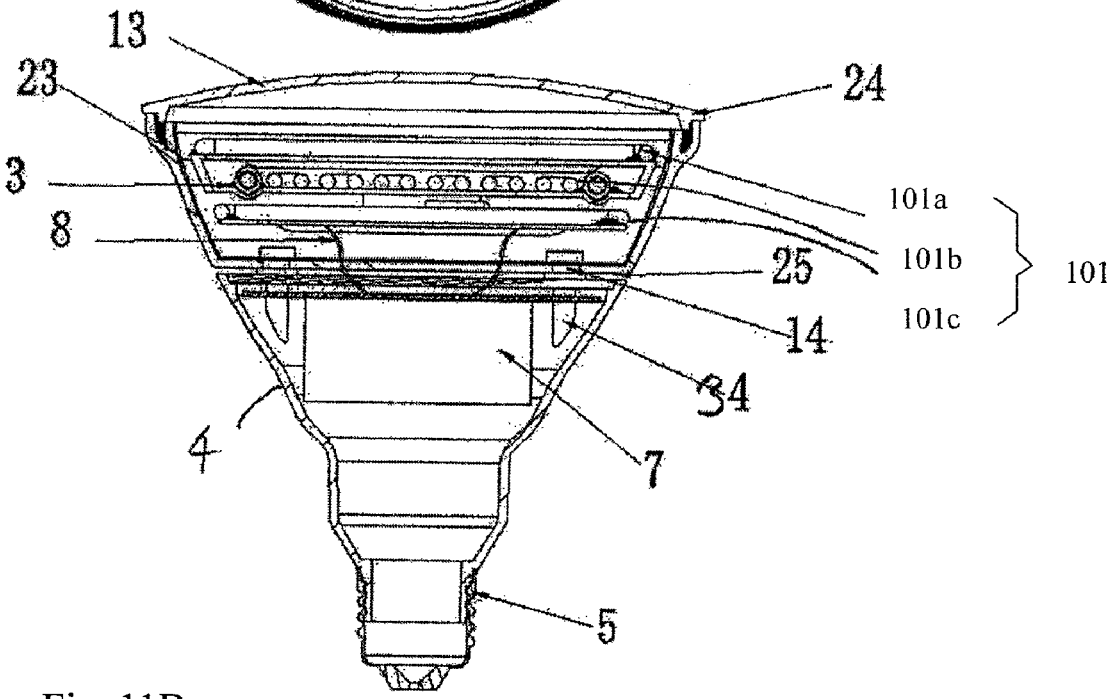
Fig. 11B

FLUORESCENT LAMP FOR LIGHTING APPLICATIONS

CLAIM OF FOREIGN PRIORITY

This application claims the benefit of the following foreign applications: Chinese Applications No. 200520013482.0, filed Jul. 20, 2005; No. 200520013483.5, filed Jul. 20, 2005; No. 200520013484.X, filed Jul. 20, 2005; No. 200520116564.8, filed Nov. 21, 2005; and No. 200520116919.3, filed Dec. 1, 2005.

BACKGROUND OF THE INVENTION

1. Field of the Invention

The present invention relates generally to a fluorescent lamp and more particularly, to a fluorescent lamp for lighting.

2. Description of the Prior Art

The existing high power tubular fluorescent lamps (FL), e.g., T12, T10, T8, T5 and T4 FL etc. are the hot cathode FL. It has been used for lighting beginning around 1940, and is widely used in the world now. It has the advantages of high efficiency, low cost and able to generate different color light. However, it has a short operating lifetime, and very short ON/OFF switching lifetime. It is also, difficult to control and change the color of light emitted by the hot cathode FL or to change its color temperature.

The cold cathode fluorescent lamp ("CCFL") has long operating lifetime, very long ON/OFF switching lifetime and high efficiency. It is widely used for LCD backlight, and some claims that the lifetime of CCFLs can be up to 60,000 hours. Cold cathode fluorescent lamp, or CCFL has been used to provide backlight for LCD display for some time. There are basically two types of CCFL backlight: (1) Edge type CCFL backlight; (2) Front type CCFL backlight; The Edge type has been the mainstream design for smaller size LCD backlights, while the Front type has emerged to be the mainstream design for the larger size LCD TV Displays.

There are three kinds of Front type CCFL backlight. A first type uses a tubular, U shape or serpentine shape CCFL in a housing, such as shown in U.S. Pat. No. 6,793,370 and U.S. Patent Pub. 2006/0023470. A second type uses a flat container containing electrodes and discharge gas to provide a flat light source. A third type uses dividers between two plates to create a serpentine shaped passage with electrodes at the two ends of the passage between the two plates in a vacuum environment to create a flat lighting source, such as shown in U.S. Pat. No. 6,765,633. All these three types of devices are used as LCD backlight. There are no controller or suitable outside connector used in conjunction with these designs to enable them to be used as general lighting devices.

The Edge type CCFL backlight needs relatively big reflector housing to provide uniform output through the whole surface, which is very important for backlight, but not for general lighting. While the other types of CCFL backlight have flat shapes, but their efficacy is relatively low due to short air discharge passage or too much heat generated during discharging. The third Front type CCFL backlight depends on using low melting point glass as building material, which can easily result in costly vacuum leaks so that it is difficult to maintain high vacuum for high CCFL efficacy.

SUMMARY OF THE INVENTION

One aspect of the invention is based on the recognition that a particularly useful and practical CCFL lighting device is provided by employing a serpentine shaped CCFL, a driver driving the CCFL, a connector that allows the device to connect to and receive power form conventional power sockets, and a fixture that connects them into a single device. Such device can be used for general lighting purposes and replaces incandescent and other fluorescent lamps in current use without having to change electrical sockets. According to one embodiment of this aspect of the invention, a CCFL device comprises at least one layer of CCFL, where the layer has at least one CCFL that is serpentine in shape and a driver including at least one CCFL driver supplying AC power to the at least one CCFL to cause it to generate light. At least one fixture supports the at least one CCFL and the driver. A connector is used having a configuration adapted to be electrically and mechanically connected to a conventional electrical socket. The at least one fixture mechanically connecting said at least one CCFL, the driver and the connector to form a unitary mechanical structure. One layer of CCFL means either a complete CCFL or a portion thereof that has a shape that fits into a plate-shaped space.

When the driver is at an elevated temperature, the operation of the driver will be adversely effected. For example, the elevated temperature may adversely affect the magnetic field in a transformer in the driver and damage electronic components in the driver such as transistors and capacitors. By introducing a thermal insulator such as an air gap between the driver and the CCFL, heat transfer from the CCFL to the driver is inhibited, thereby preserving the integrity of the driver and its components, thereby avoiding shortening the useful life of the driver.

According to one embodiment of another aspect of the invention, a CCFL device comprises at least one layer of CCFL, having at least one CCFL having a serpentine shape, a CCFL driver, said driver supplying AC power to the at least one CCFL to cause it to generate light and at least one fixture supporting the at least one CCFL and the driver in a manner such that the driver is separated from the at least one CCFL by at least an air gap. As noted above, the air gap will preserve the integrity of the driver and its components, thereby avoiding shortening the useful life of the driver. A connector is used having a configuration adapted to be electrically and mechanically connected to a conventional electrical socket. The at least one fixture mechanically connects the at least one CCFL, the driver and the connector to form a unitary mechanical structure.

The above embodiment contains at least one layer of CCFL, such layer having at least one serpentine shape CCFL. In one implementation of such embodiment, embodiment also includes one CCFL controller or partial controller containing at least a transformer and its supporting components. One outside electrical connector having a configuration adapted to be electrically and mechanically connected to a conventional electrical socket is used, as well as at least one fixture mechanically connecting said at least one CCFL, the controller and the connector to form an unitary structure.

One embodiment of yet another aspect of the invention includes a heat insulator between a first chamber housing at least one layer of CCFL, having at least one serpentine CCFL with its supporting means, and a second chamber housing a CCFL controller, which contains at least one transformer and its supporting components. One outside electrical connector is used having a configuration adapted to be electrically and mechanically connected to a conventional electrical socket, as well as at least one fixture mechanically connecting said at least one CCFL, the controller and the connector to form an unitary structure. Preferably in this implementation, the unitary structure takes on one of the conventional shapes of lamps, such as that of the MR16, GX53, or PAR type of reflector lamps

BRIEF DESCRIPTION OF THE DRAWINGS

The accompanying drawings, which are included to provide further understanding of the invention and are incorporated in and constitute a part of this application, illustrate embodiments of the invention and together with the description serve to explain the principle of the invention.

FIG. 10A is a top view of a CCFL fluorescent lamp having a serpentine shaped CCFL in two layers to illustrate still one more embodiment of the invention.

FIG. 10B is a side view of the fluorescent lamp of FIG. 10A.

FIG. 11A is a top view of a CCFL fluorescent lamp with a serpentine shaped CCFL in three layers to illustrate another embodiment of the invention.

FIG. 11B is a side view of the fluorescent lamp of FIG. 11A.

For simplicity in description, identical components are labeled by the same numerals in this application.

DETAILED DESCRIPTION OF THE PREFERRED EMBODIMENTS

One embodiment of the invention provides a high efficacy, high light output, long lifetime, thin profile with good mechanical strength, dimmable and color adjustable flat light source that can be widely used in general lighting applications. It is based on the recognition that by providing a flat housing design, such that heat can be dissipated easily through air circulation of the CCFL in this housing, or thermal conduction through the CCFL supporting material of this housing, so that CCFL can be operated in this housing at a desirable temperature range of ~70 C and heat generated by the CCFL cannot affect its controlling electronics, which is also housed in the vicinity of the CCFL.

Figures 1A, 1B:
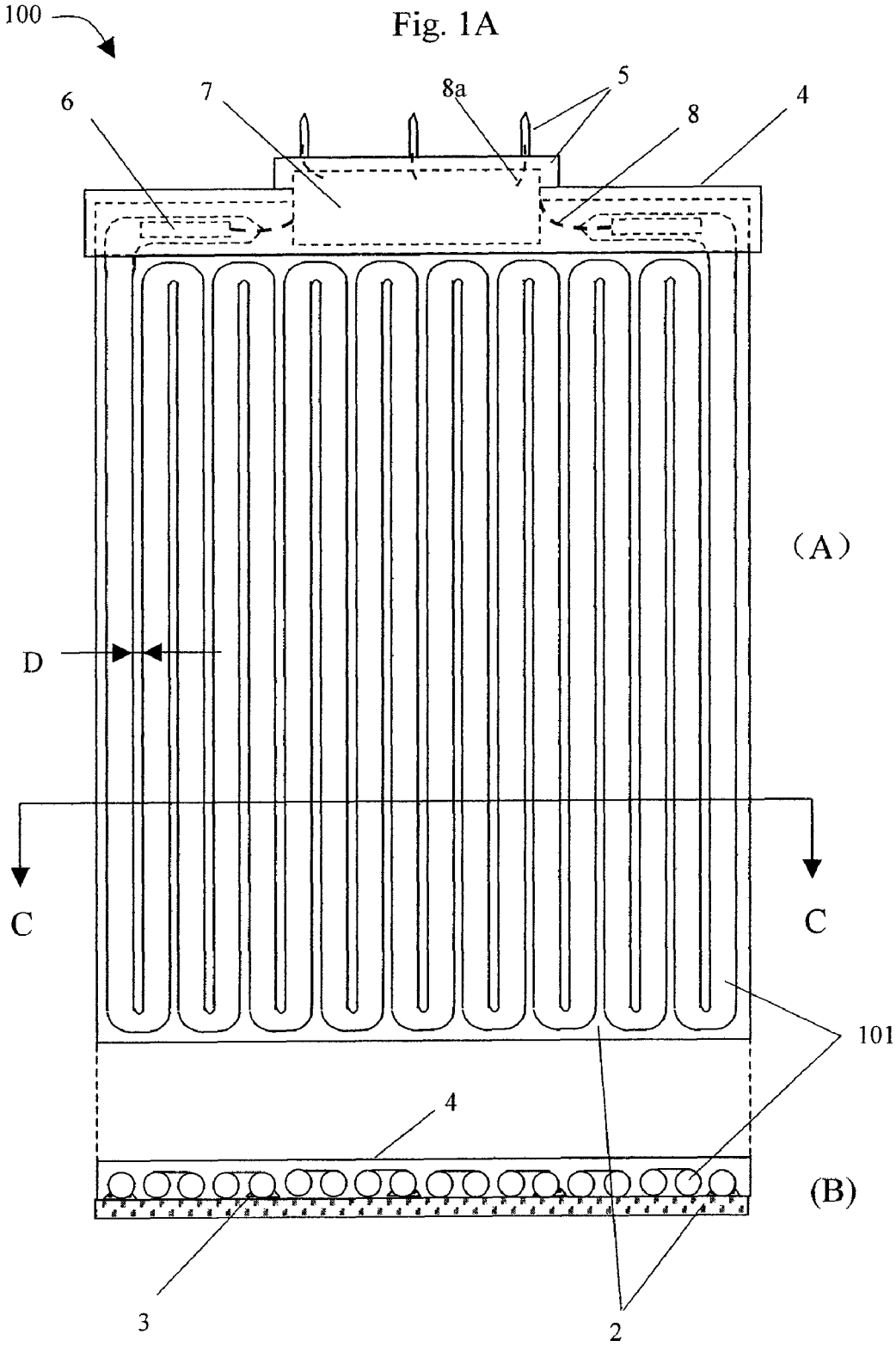
FIG. 1A is a schematic view of a flat fluorescent lamp to illustrate one embodiment of the invention.
FIG. 1B is a cross sectional view of the fluorescent lamp of FIG. 1A along the line C-C in FIG. 1A.

FIGS. 1A and 1B are respectively a schematic and cross sectional views of a CCFL device 100 to illustrate one embodiment of the invention. FIG. 1B is a cross sectional view of the fluorescent lamp of FIG. 1A along the line C-C in FIG. 1A. As shown in FIGS. 1A and 1B, a serpentine shaped CCFL 101 is substantially planar and flat having the overall shape of a rectangular plate. The serpentine shape of CCFL 101 is formed by straight segments of CCFL arranged substantially parallel to one another, with adjacent ends of certain segments connected to form the serpentine shape as shown in FIG. 1A. CCFL 101 is attached to a support plate 2 by means of adhesive 3. The fixture 4 together with support plate 2 form a housing which is not a closed structure for the CCFL 101, but is open on one side, the side opposite to support plate 2. An electrical connector 5 is used to connect driver 7 to power sockets (not shown) for powering the CCFL device 100. Fixture 4 also encloses electrodes 6 of the CCFL 101, driver 7 and connector 5 on one side of the CCFL device 100. Wires 8 connect the driver 7 to electrodes 6 of the CCFL. Driver 7 converts input power such as at 100 to 230 volts and 50 or 60 hertz or DC power at several to few hundred volts to AC power suitable for CCFL operation, such as output AC power at about 5 to 3000 volts and 1 to 800 kilohertz. Preferably driver 7 includes at least a transformer and its supporting components (not shown) for converting a lower voltage to a higher voltage. In one embodiment, driver 7 receives a control signal from a controller (not shown) not a part of device 100 for controlling the operation of device 100. Fixture 4 may comprise a transparent solid or hollow member or body, and is preferably made of a glass, plastic, ceramic or metallic material. Fixture 4 connects the CCFL 101, driver 7, and connector 5 to form a unitary structure, with optional support plate 2.

Preferably, most of the length of CCFL 101 is exposed to air at least on the side of CCFL 101 opposite to plate 2, so that the heat generated by the CCFL can be easily dissipated. For low power flat fluorescent lamps, since the heat generated by the CCFL is small, in order to maintain the CCFL at a suitable high temperature, the distance between adjacent segments of the CCFL 101, D, may be selected to be small and both sides of the CCFL may have support plates instead of having a single plate 2. In such event, preferably, the distance D is smaller than twice the outside diameter of the segments of CCFL 101. Support plate 2 preferably is transparent or transmits diffuse light. Alternatively, plate 2 may have a light reflective surface, or has lenses and/or prisms. Connector 5 is in a shape suitable for connection to conventional sockets for general lighting.

Figures 2A, 2B:
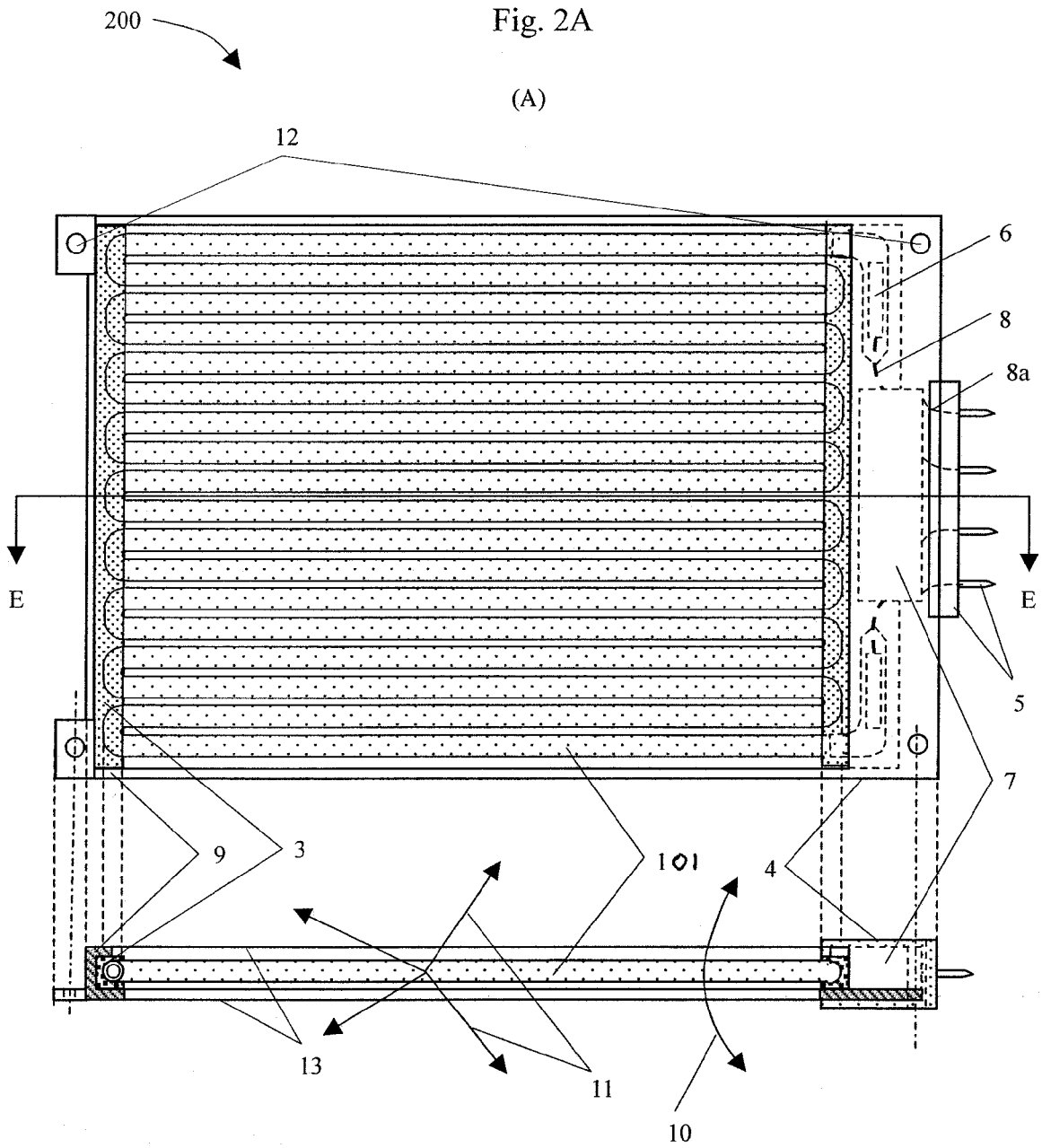
FIG. 2A is a schematic view of a fluorescent lamp to illustrate another embodiment of the invention.
FIG. 2B is a cross sectional view along the line E-E in FIG. 2A.

FIG. 2A and 2B illustrate yet another embodiment of the invention. As shown in FIGS. 2A and 2B, device 200 includes a frame 9 so that the CCFL 101 is suspended within frame 9, without a support plate next to the CCFL. In this manner, air currents may pass through the gaps between the segments of the CCFL 101 within frame 9 for carrying away heat generated by the CCFL. Frame 9 may form a unitary structure with fixture 4. Frame 9 is preferably made of glass, plastic, ceramic or metallic material. It can have one or two light outputting windows situated at opposite side. Arrows 11 illustrate two light outputting windows in FIG. 2B. Light outputting windows of frame 9 may have rectangular, circular, square, oval or other geometrical shapes. In other respects, device 200 resembles device 100 of FIGS. 1A and 1B.

Figure 3:
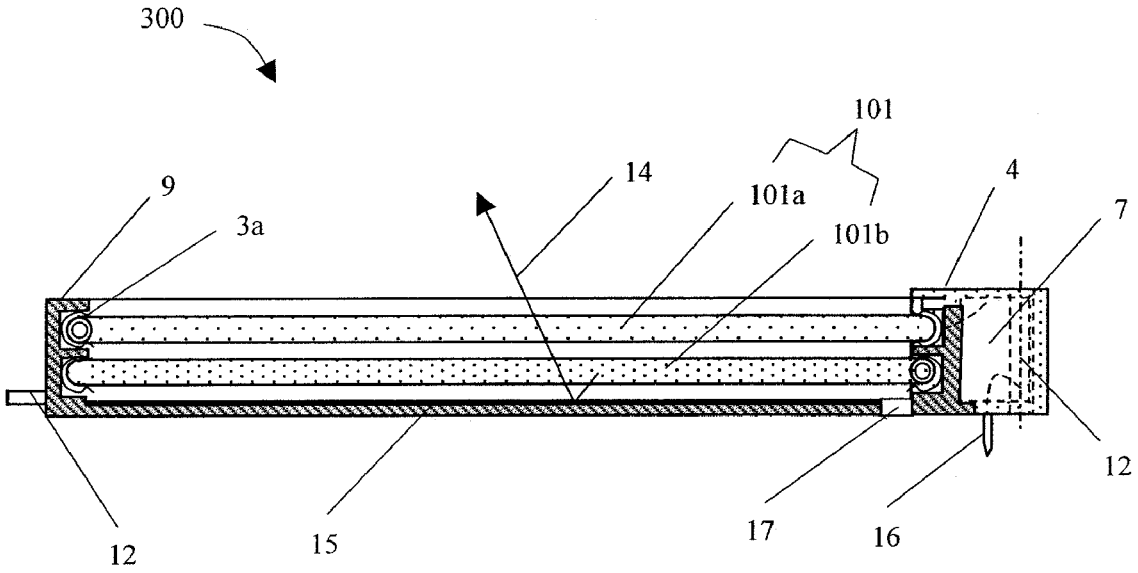
FIG. 3 is a schematic view of a flat fluorescent lamp to illustrate yet another embodiment of the invention.

FIG. 3 is a schematic view of a CCFL device 300 to illustrate still another embodiment of the invention. Different from the embodiments of devices 100 and 200, device 300 includes a CCFL 101 which is formed by two layers of CCFLs, having one whole CCFL or a portion thereof in each layer: 101*a* and 101*b*. Each of the two CCFLs or CCFL portions may have a shape similar to that of CCFL 101 in devices 100 and 200. When 101*a* and 101*b* are portions connected to form a single CCFL 101, this increases the length of the CCFL that fits within the same area or footprint occupied by a single layer CCFL that is only half its length. In this case, CCFL 101 can achieve high power within smaller area size when compared to its single layer counterpart. CCFL 101 may be connected to frame 9 by means of a mechanical connector 3*a* such as a rivet or silicon type of adhesive means. For heat dissipation, at least one hole 17 is provided in reflector plate 15 that reflects light generated by CCFL 101 towards window along directions such as along arrow 14.

Alternatively, device 300 may include two different and separate CCFLs 101*a* and 101*b*, so that they may be separately controlled to emit different lighting. In one embodiment of such CCFL device 300, such device comprises at least two CCFLs: at least one with high color temperature phosphor and at least one with low color temperature phosphor, or at least one with low color temperature phosphor and at least one with mixture of green-blue color phosphor. By using one or more drivers to control power supplied to the CCFLs to change the relative light intensities of the light emitted by these CCFL tubes with different phosphors, to obtain different color temperature lights, it is possible to design the device as an adjustable color temperature lamp and/or an adjustable color temperature and dimmable lamp. For example, where three CCFL tubes have red, green and blue phosphors respectively, one or more drivers may be used to control power supplied to the three CCFLs to change the relative light intensities of the light emitted by these CCFL tubes so that the device is a light color variable lamp and/or a light color variable and dimmable lamp.

Frame 9, which can be opened, or closed at both sides of the planar CCFL(s), CCFL(s) 101, its or their driver 7, reflector plate 15, housing 4, outside electrical connector 16 are connected to form an unitary mechanical structure for general lighting.

Figure 4:
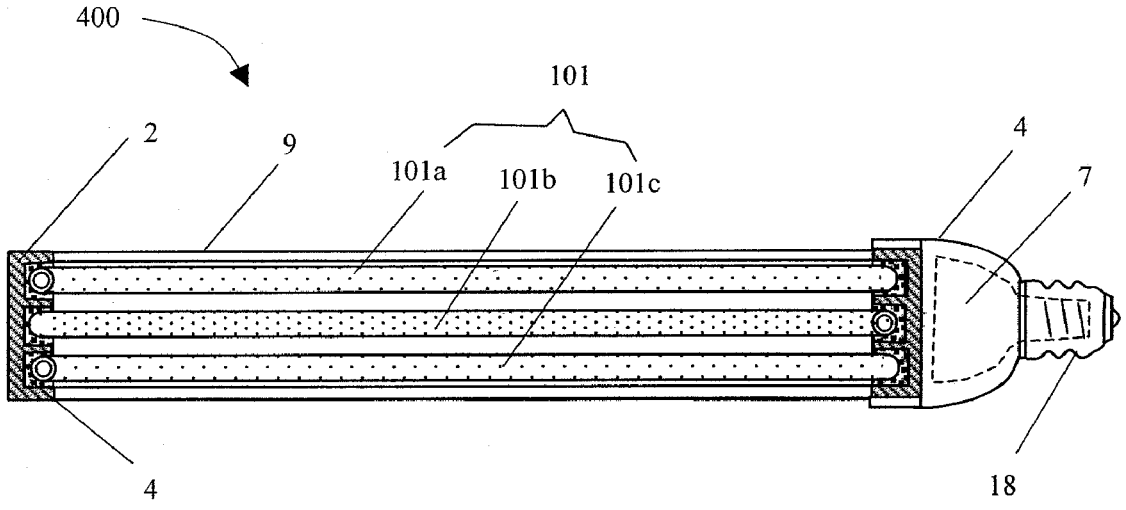
FIG. 4 is a schematic view of a flat fluorescent lamp to illustrate one more embodiment of the invention.

FIG. 4 illustrates another CCFL device 400 for another embodiment. Device 400 differs from device 300 in that the CCFL 101 comprises three portions 101*a*, 101*b* and 101*c*, instead of just two, where each portion is similar to CCFL 101 in devices 100 and 200 and the three portions are connected to form a single CCFL. In this case, it is possible to increase the CCFL length within the original area size of device 100 by three times. Thus a even higher power CCFL lamp than the previous embodiments can be made.

Alternatively, device 400 may include three different and separate CCFLs 101*a*, 101*b* and 101*c*, so that they may be separately controlled. In one embodiment of such CCFL device 400, such device comprises at least two CCFLs with phosphor of different color temperatures, or at least one CCFL with phosphor of low color temperature and one CCFL with phosphor mixture of green-blue phosphors. By using one or more drivers to adjust power supplied to the CCFLs to change the relative light intensities of the light emitted by the CCFLs with different color temperature, one can obtain different color temperatures, thus, it is possible to design the device as an adjustable color temperature lamp and/or an adjustable color temperature and dimmable lamp.

In addition to using the above CCFL device arrangements 300 and 400 with multiple CCFLs that are separately controlled for general lighting applications, it is also possible to design a CCFL device that generates multi-color (e.g. colors based on the mixture of colors generated by the red, blue and green phosphors) lighting for various applications. For this purpose, two or more CCFLs may be used each having red, green or blue basic color phosphor. A driver circuit converts input electric power to an AC output in the range of about 5 to 400 volts and at a frequency in the range of about 1 kc-800 kc. At least one high voltage transformer responds to said AC output to cause suitable voltage(s) to be supplied to each of the two or more CCFLs to cause the CCFLs to supply light. In one embodiment, a plurality of CCFL lamp units each having two or more CCFLs are used, each unit equipped with its high voltage transformer(s) that supplies a suitable voltage to the CCFL(s) of such unit. Hence, one or more driver circuits applying AC outputs to the two or more CCFL lamp units may apply AC outputs that are different from one another, so that the two or more CCFL units are individually controlled to emit light of the same or different intensities and produce a mixture light of various colors.

Frame 9, which can be opened or closed with or without face plates at both sides of the planar CCFL 101, connects the CCFL 101, its driver 7 and its housing 4, its outside electrical connector 18 to form an unitary mechanical structure for general lighting.

Figure 5:
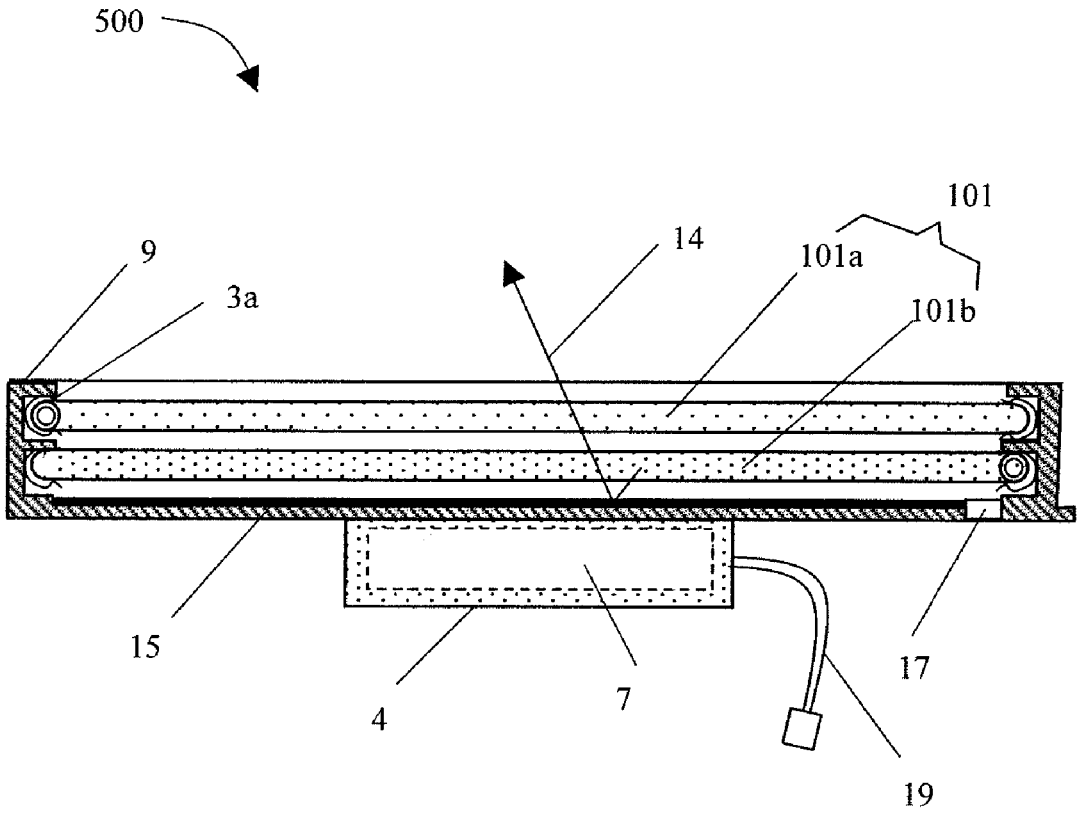
FIG. 5 is a schematic view of a fluorescent lamp to illustrate yet one more embodiment of the invention.

FIG. 5 illustrates another CCFL device 500 for another embodiment. Device 500 differs from device 300 in that in the CCFL device 500, driver 7 and fixture 4 are located at the side of reflective plate 15 opposite to that of CCFL(s) 101*a* and 101*b*. Cable 19 connects driver 7 to an external power outlet.

Figure 6:
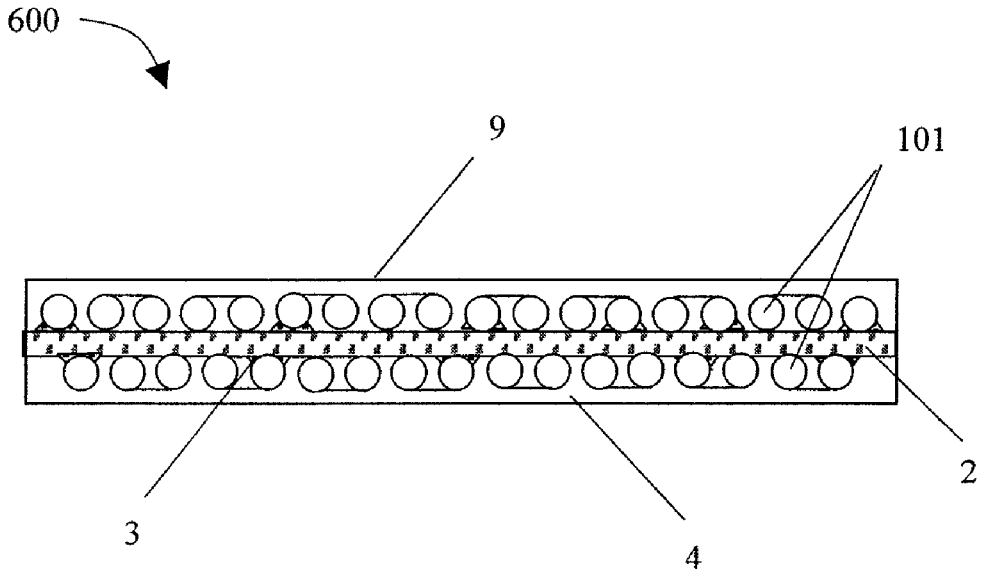
FIGS. 6 and 7 are schematic views of two more arrangements of CCFL to illustrate more embodiments of the invention.
Figure 7:
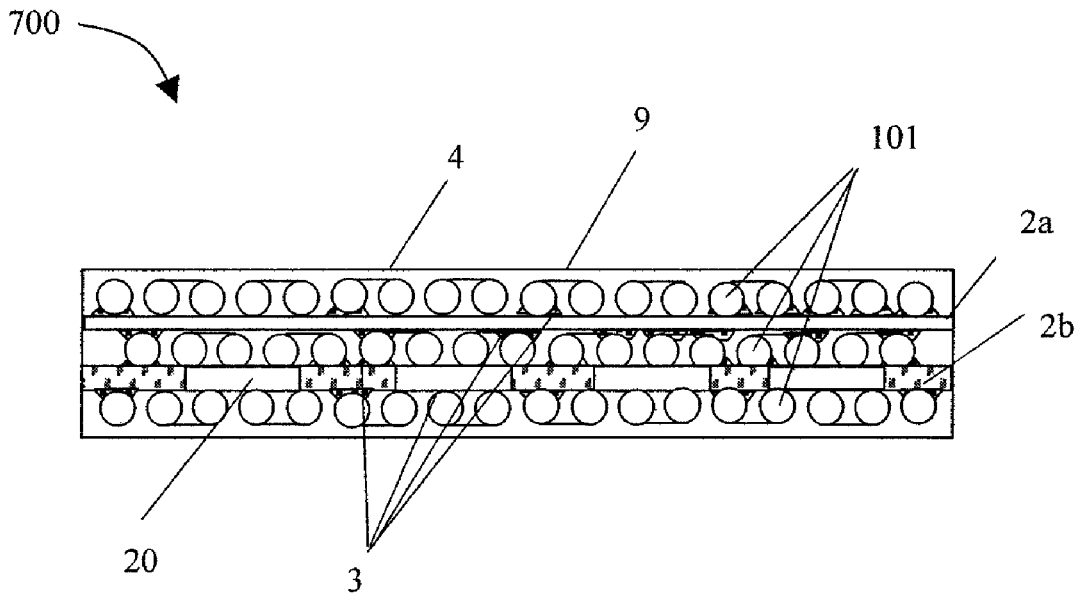

FIGS. 6 and 7 illustrate different arrangements for the CCFL to illustrate more embodiments. As shown in FIG. 6, the CCFL 600 may have two portions in two layers separated by a plate 2, to which the two portions are attached by means of silicon type of adhesive 3. Alternatively, there may be two different CCFLs attached to the two sides of plate 2. As shown in FIG. 7, the CCFL 700 may have three portions in three layers separated by plates 2*a* and 2*b*, to which the three portions are attached by means of silicon types of adhesive 3. Alternatively, there may be three different CCFLs attached to the two sides of plates 2*a* and 2*b*. The plates 2*a*, 2*b* can be in the form of a planar structures, with at least one hole for air circulation, or be replaced by an array of transparent rods or strips 2*b* with spaces 20 in between as shown in FIG. 7 to allow more space for air circulation to dissipate heat. Frame 9 of device 600 can be a closed frame, or with one or both light outputting windows open to air.

Figures 8A, 8B:
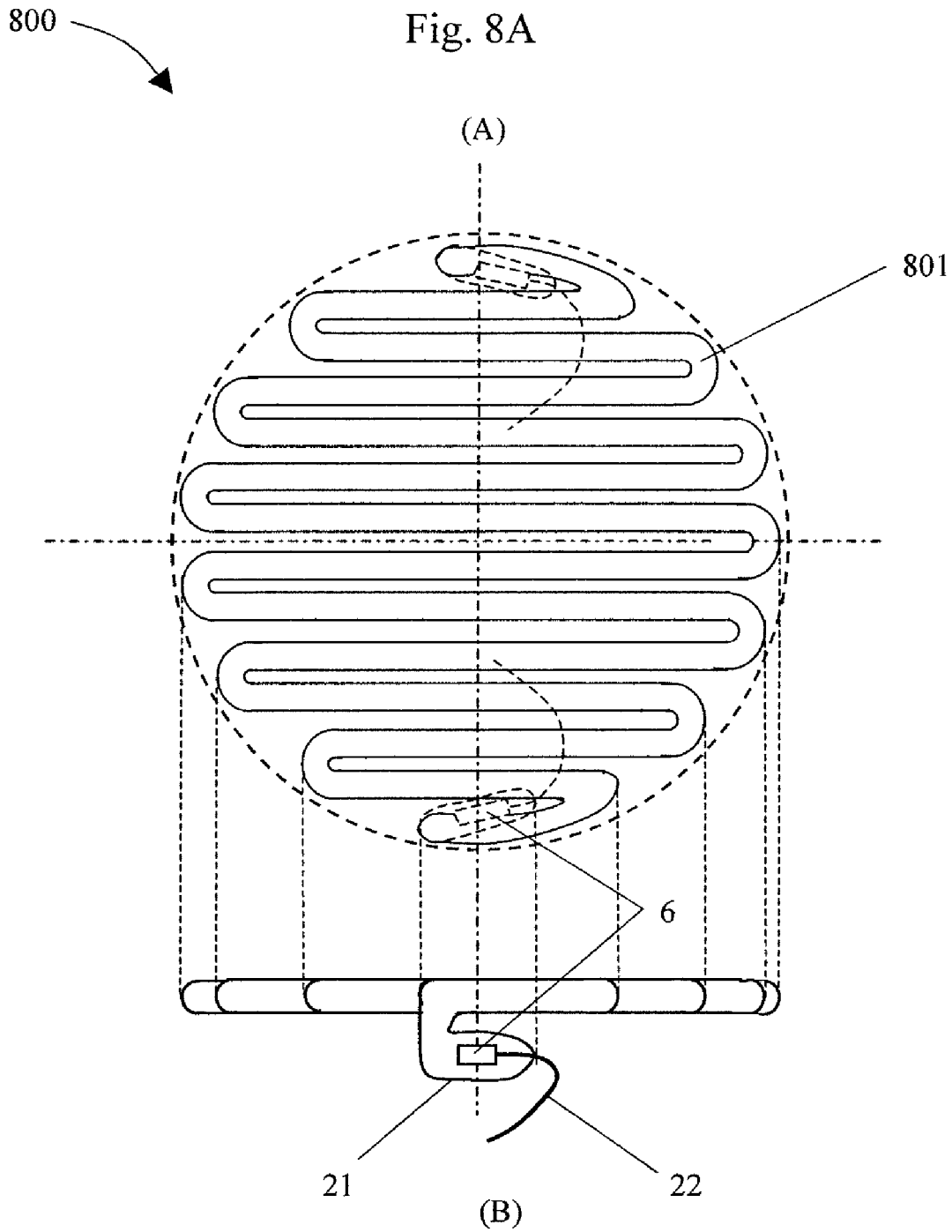
FIG. 8A is a schematic view of the shape of a serpentine shaped CCFL to illustrate yet one more embodiment of the invention.
FIG. 8B is a side view of the CCFL of FIG. 8A.

FIGS. 8A and 8B illustrate a shape of serpentine CCFL 801 for another embodiment. As shown in FIG. 8A, CCFL 801 is substantially flat and planar, having an overall circular, oblong or elliptical plate like shape. Its two electrodes are bent backwards to maintain an overall circular shape of the CCFL.

Figures 9A, 9B:
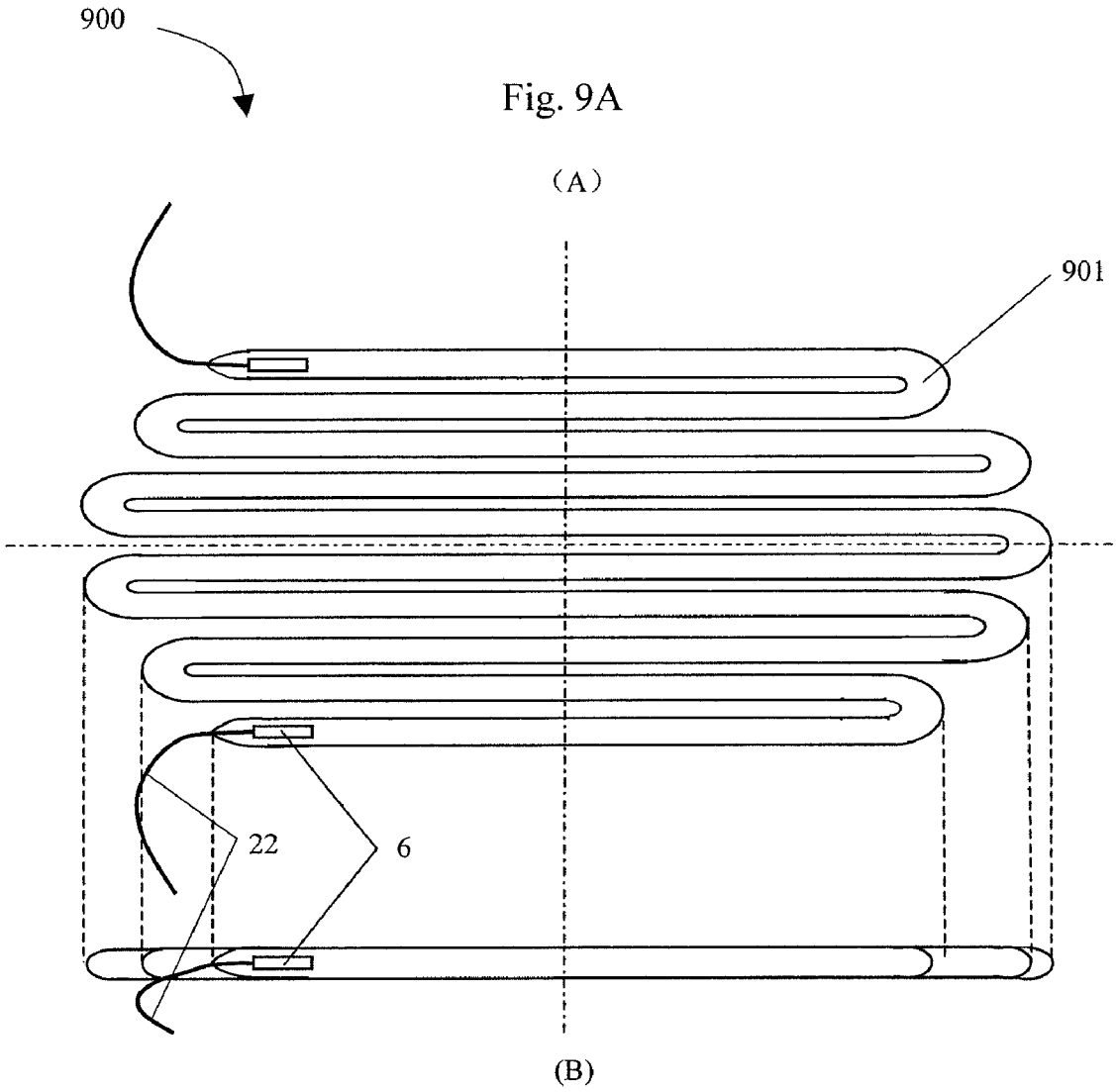
FIG. 9A is a top view of a serpentine shaped CCFL in a single layer to illustrate one embodiment of the invention.
FIG. 9B is a side view of the fluorescent of FIG. 9A.

FIGS. 9A and 9B illustrate a shape of serpentine CCFL 901 for another embodiment. As shown in FIG. 9A, CCFL 901 is substantially flat and planar, having an overall partially oblong or partially elliptical plate like shape.

FIGS. 10A and 10B are respectively the top and side views of a CCFL device 1000 illustrating yet another embodiment of the invention. CCFL device 1000 contains a CCFL 101, which preferably has two portions each having a serpentine shape, and has overall planar flat shapes that resemble plate-like layer structures. The serpentine shape of CCFL 101 comprises straight segments arranged substantially parallel to one another, with adjacent ends of certain segments connected to form the serpentine shape. As shown in FIGS. 10B, CCFL 101 is substantially two circular discs stacked on top of each other in overall shape. CCFL lamp 1000 includes two chambers: a first chamber enclosed within an upper housing 32 and second chamber enclosed within a lower housing 33, where the two housings are connected by connectors 34. The chamber defined by housing 32 contains the CCFL 101. The second housing 33 defines a chamber which contains the driver 7.

The CCFL 101 is attached to a reflector plate 23 on and attached to the upper housing 32 by means of silicon type of adhesive 3. The CCFL 101 is electrically connected to driver 7 by wires 8. Light emitted by the CCFL 101 is transmitted through a light transmitting or transparent plate 24 in window 13. Plate 24 may comprise a transparent, diffused or patterned material. The electrical connector 5 is the conventional connector for the GX53 type of lamp. The connectors 34 are of such dimension that the two chambers in upper and lower housings 32 and 33 are spaced apart by a thermal insulator such as an air gap 25 to reduce heat transfer from the CCFL to the driver 7. Wire 8 passes through holes in the upper and lower housings 32 and 33 to connect the CCFL 101 to driver 7.

One of the problems encountered in designing a high power fluorescent lamp for replacement of the current high power lamps is that the fluorescent lamp generates an abundance of heat, especially when it is enclosed in a closed chamber. A driver is required to supply the appropriate voltage and currents to the fluorescent lamp causing it to generate light. If the driver that converts low frequency low voltage power to high frequency high voltage power for powering CCFLs is placed in the vicinity of the lamp, the heat generated by the CCFLs may cause the driver components to be at an elevated temperature, which may adversely effect the operation of the driver and shorten the useful life of its components.

When the driver is at an elevated temperature, the operation of the driver will be adversely effected. For example, the elevated temperature may adversely affect the magnetic field in a transformer in the driver and damage electronic components in the driver such as transistors and capacitors. By introducing a thermal insulator such as an air gap 25 in FIG. 10B between the driver 7 and the CCFL 101, heat transfer from the CCFL to the driver is inhibited, thereby preserving the integrity of the driver and its components and thereby avoiding shortening the useful life of the driver.

The CCFL 101 in CCFL chamber 32 shown here preferably has two layers, which can be arranged in directions substantially parallel, perpendicular or transverse to each other. The two layers of CCFL can comprise two different and separate CCFLs having same phosphor or phosphor of different color temperatures. By controlling these two CCFLs through driver 7 can produce high power CCFL or high power CCFL with adjustable color temperature capability as described above in reference to FIGS. 3 and 4.

The CCFL lamp 1100 of FIGS. 11A and 11B contains a CCFL 101 having three portions in three different layers which can have three different configurations: (1) When connected together as a single CCFL with same phosphor, it can make very high power CCFL lamp, but requires high driving voltage; (2) When arranged as three separated CCFLs with same phosphor, it can be connected in parallel and driven by a single controller with substantially lower driving voltage than (1); (3) When arranged as three separated CCFLs with different phosphors, like red, green, and blue phosphors, it can display multiple colors including the most commonly used cold and warm white light for general lighting. The CCFL 101 is housed within a chamber defined by annular reflector 23, and cover 24, which together form a chamber that encloses CCFL 101. Fixture 4 has a top cover so that it together with connector 5 forms a chamber that encloses driver 7. Fixture 4 is mechanically connected to connector 5. The two housing structures 4 and 23 are connected together by means of connectors 34, so that an air gap 25 is maintained between the two chambers. This air gap will have the same effect as that described above in reference to FIG. 10B in drastically reducing the amount of heat that is transferred from the CCFL to the driver 7. Wire 8 passes through holes in the two housings 4 and 23 to connect the CCFL 101 to driver 7. Optionally, connectors 34 may have holes therein for wires 8 to pass.

While the invention has been described above by reference to various embodiments, it will be understood that changes and modifications may be made without departing from the scope of the invention, which is to be defined only by the appended claims and their equivalent. All references referred to herein are incorporated herein by reference.

The invention claimed is:

1. A CCFL device, comprising:

at least two adjacent and overlapping layers of CCFLs, each layer comprising at least one CCFL, for a total of at least two CCFLs said at least two CCFLs emitting light of different color temperatures, each of said at least two CCFLs comprising elongated segments connected at their ends to form a serpentine shape, said segments in each of said at least two CCFLs being substantially parallel to one another, the segments in said at least two CCFLs being transverse to one another;

a driver converting an input power to AC power of higher voltage suitable for CCFL operation, and supplying the higher voltage AC power to the at least two CCFLs to cause it to generate light;

at least one fixture supporting the at least two CCFLs and the driver, said at least one fixture including a supporting plate and means for attaching to the supporting plate the at least two CCFLs at a plurality of locations along their lengths;

a connector having a configuration adapted to be electrically and mechanically connected to a conventional electrical socket to support and power the device, said at least one fixture mechanically connecting said at least two CCFLs, the driver and the connector to form a unitary mechanical structure;

a housing defining a chamber therein that houses said at least two CCFLs; and a driver housing defining a chamber therein that houses said driver, wherein said driver housing and said housing that houses said at least two CCFLs are spaced apart by an air gap external to the device.

2. The device of claim 1, the segments being separated from each other by a distance smaller than twice an outside diameter of the segments.

3. The CCFL device of claim 1, said driver supplying power separately to the CCFLs to control the intensity of light emitted by the at least two CCFLs for controlling dimming or color temperature of the light emitted by the at least two CCFLs.

4. The CCFL device of claim 3, wherein said at least two CCFLs comprise phosphors of different color temperatures or comprise at least one CCFL with low color temperature phosphor and at least one CCFL with mixture of blue-green phosphor.

5. The CCFL device of claim 3, said device comprising:

at least one set of red, green and blue light color emitting CCFLs, said driver controlling power supplied to the at least two CCFLs to change the relative light intensities of the red, green and blue light emitted by the at least two CCFLs so that the device is a light color variable lamp and/or a light color variable and dimmable lamp.

6. The CCFL device of claim 3, said CCFL fixture comprising at least one light outputting window, said window having substantially square, circle, rectangular or oval shapes.

7. The device of claim 1, said attaching means comprising at least one mechanical means or silicon type of adhesive means securing the at least two CCFLs onto the supporting plate.

8. The device of claim 7, said at least one supporting plate being transparent and comprises a glass, metallic, ceramic or plastic material, said plate comprising a solid or hollow body.

9. The device of claim 1, said supporting plate having one or more holes therein for air circulation, or an array of transparent rods, or strips.

10. The CCFL device of claim 1, wherein said fixture comprises at least one light outputting window, said window comprising a glass, metallic, ceramic or plastic material that is square, circle, rectangular or oval in shape.

11. The device of claim 10, wherein said fixture comprises only one light outputting window, and a reflector surface facing the light outputting window with said at least two CCFLs secured to it by at least one mechanical means or silicon type of adhesive, said reflector surface comprising a mirror or diffused reflector, having a concave, convex or rough surface finish.

12. The device of claim 1, wherein said housing is flat in shape.

13. The device of claim 1, each of said at least two layers of CCFLs being a substantially planar structure.

14. The device of claim 1, further comprising connectors connecting the two housings to maintain said air gap between the two housings.

15. The device of claim 1, said supporting plate having a reflective surface.

16. A CCFL device, comprising:

at least two adjacent and overlapping layers of CCFLs, each layer comprising at least one CCFL, for a total of at least two CCFLs said at least two CCFLs emitting light of different color temperatures, each of said at least two CCFLs comprising elongated segments connected at their ends to form a serpentine shape, said segments in each of said at least two CCFLs being substantially parallel to one another, the segments in said at least two CCFLs being transverse to one another;

a CCFL driver converting an input power to AC power of higher voltage suitable for CCFL operation, and, said driver supplying the higher voltage AC power to the at least two CCFLs to cause them to generate light;

at least one fixture comprising a first housing defining a chamber containing the at least two CCFLs and a second housing defining a chamber containing the driver such that the first housing is separated from the second housing by at least an air gap external to the device; and a connector having a configuration adapted to be electrically and mechanically connected to a conventional electrical socket to support and power the device, said at least one fixture mechanically connecting said at least two CCFLs, the driver and the connector to form a unitary mechanical structure.

17. The device of claim 16, wherein said air gap is at least 0.5 mm.

18. The device of claim 16, said at least one fixture including a light reflective surface that reflects light generated by said at least the at least two layers towards a light transmitting window.

19. The device of claim 16, said first chamber is enclosed by a flat housing.

20. The device of claim 19, said housing having a face plate at a light outputting window, said face plate comprising a transparent, diffused or patterned material.

21. The device of claim 16, further comprising mechanical connectors, said first and second chambers being mechanically connected and attached by said mechanical connectors to maintain said air gap between the two chambers and to reduce heat conduction between the two chambers.

22. The device of claim 21, said mechanical connectors having conduits therein, said device further comprising electrical connectors passing through said conduits connecting the driver and said at least two CCFLs.

23. The device of claim 16, said unitary mechanical structure is of a shape similar to a shape of MR16, GX53 or PAR type of conventional reflector lamps.

24. The CCFL device of claim 16, said driver supplying power separately to the CCFLs to control the intensity of light emitted by the CCFLs for controlling dimming or color temperature of the light emitted by the CCFLs.

25. The CCFL device of claim 24, wherein said at least two CCFLs comprise phosphors of different color temperatures or comprise at least one CCFL with low color temperature phosphor and at least one CCFL with a mixture of blue-green phosphor.

26. The CCFL device of claim 24, said device comprising:

at least one set of red, green and blue light color emitting CCFLs, said CCFL driver controlling power supplied to the at least two CCFLs to change the relative light intensities of the red, green and blue light emitted by the at least two CCFLs so that the device is a light color variable lamp and/or a light color variable and dimmable lamp.

27. The device of claim 16, said first chamber enclosed by a first housing with housing wall and said second chamber enclosed by a second housing with housing wall, wherein said at least air gap separates adjacent portions of the housing walls of the two housings.

28. A CCFL device, comprising:

at least two adjacent and overlapping layers of CCFLs, each layer comprising at least one CCFL, for a total of at least two CCFLs said at least two CCFLs emitting light of different color temperatures, each of said at least two CCFLs comprising elongated segments connected at their ends to form a serpentine shape, said segments in each of said at least two CCFLs being substantially parallel to one another, the segments in said at least two CCFLs being transverse to one another at least one fixture supporting the at least two layers of CCFLs; and a connector, said at least one fixture mechanically connecting said at least two layers of CCFLs and the connector to form a unitary mechanical structure.

29. The CCFL device of claim 28, further comprising a driver that converts an input AC power to AC power of higher voltage and supplying the higher voltage AC power separately to the at least two layers of CCFLs to cause them to generate light of desired intensities for controlling color temperature of the light emitted by the at least two layers of CCFLs.

30. The CCFL device of claim 28, said connector having a configuration adapted to be electrically and mechanically connected to a conventional electrical socket to support and power the device.

31. The CCFL device of claim 28, each of said at least two layers of CCFLs having a substantially planar flat structure.

32. The CCFL device of claim 31, said at least one fixture comprising an open or closed frame and a supporting plate attached to and separating the at least two layers of CCFLs.

33. The CCFL device of claim 32, said fixture further comprising means for attaching to the supporting plate the at least two layers of CCFLs at a plurality of locations along their lengths.

34. The CCFL device of claim 32, wherein said supporting plate is transparent or transmits diffuse light.

35. The CCFL device of claim 28, further comprising a driver that converts an input AC power to AC power of higher voltage and supplying the higher voltage AC power separately to the at least two layers of CCFLs to cause them to generate light of desired intensities for controlling dimming of the light emitted by the at least two layers of CCFLs.

36. The device of claim 28, wherein said at least two adjacent and overlapping layers of CCFLs fit within substantially the same area occupied by a single layer CCFL.

37. The device of claim 28, wherein two of said at least two adjacent and overlapping layers of CCFLs fit within substantially the same area occupied by a single layer CCFL that is only about half the total lengths of the two layers of CCFL.

38. A CCFL device, comprising:

a CCFL having at least two portions connected to form a single CCFL, each portion having a serpentine shape and a plate-like layer structure, the two portions stacked on top of each other and emitting light of the same color temperature, each of said at least two portions comprising an array of elongated segments with adjacent ends connected at a plurality of locations on each of two opposite sides of the array to form a serpentine shape and a substantially planar flat structure, said segments being substantially parallel to one another, the segments in said at least two portions being substantially transverse to one another;

at least one fixture supporting the at least two portions of CCFLs; and a connector, said at least one fixture mechanically connecting said at least two portions of CCFLs and the connector to form a unitary mechanical structure.

* * * * *